US009234423B2

(12) United States Patent
Bush et al.

(10) Patent No.: US 9,234,423 B2
(45) Date of Patent: Jan. 12, 2016

(54) SUPER-HARD TIP FOR A PICK TOOL AND PICK TOOL COMPRISING SAME

(71) Applicants: ELEMENT SIX ABRASIVES S.A., Luxembourg (LU); ELEMENT SIX GMBH, Burghaun (DE)

(72) Inventors: Peter Bush, Springs (ZA); Bernd Heinrich Ries, Burghaun (DE); Robert Fries, Springs (ZA); Cornelis Roelof Jonker, Springs (ZA)

(73) Assignees: Element Six Abrasives S.A., Luxembourg (LU); Element Six GmbH, Burghaun (DE)

( * ) Notice: Subject to any disclaimer, the term of this patent is extended or adjusted under 35 U.S.C. 154(b) by 0 days.

(21) Appl. No.: 14/366,211

(22) PCT Filed: Dec. 12, 2012

(86) PCT No.: PCT/EP2012/075234
§ 371 (c)(1),
(2) Date: Jun. 17, 2014

(87) PCT Pub. No.: WO2013/092346
PCT Pub. Date: Jun. 27, 2013

(65) Prior Publication Data

US 2014/0361601 A1 Dec. 11, 2014

Related U.S. Application Data

(60) Provisional application No. 61/579,405, filed on Dec. 22, 2011.

(30) Foreign Application Priority Data

Dec. 22, 2011 (GB) ..... 1122187.6

(51) Int. Cl.
*E21C 35/183* (2006.01)
*E21B 10/56* (2006.01)
(Continued)

(52) U.S. Cl.
CPC ..... *E21C 35/183* (2013.01); *B28D 1/186* (2013.01); *E21B 10/56* (2013.01); *E21C 35/18* (2013.01); *E21C 2035/1803* (2013.01); *E21C 2035/1813* (2013.01)

(58) Field of Classification Search
None
See application file for complete search history.

(56) References Cited

U.S. PATENT DOCUMENTS 4,109,737 A * 8/1978 Bovenkerk ..... 175/430
4,981,328 A * 1/1991 Stiffler et al. ..... 299/111
(Continued)

FOREIGN PATENT DOCUMENTS

GB 2493282 A 1/2013
WO 2008105915 A2 9/2008
(Continued)

OTHER PUBLICATIONS

United Kingdom Application No. 1122187.6, Combined Search and Examination Report mailed on Jan. 17, 2012, 7 pages.
(Continued)

*Primary Examiner* — John Kreck
(74) *Attorney, Agent, or Firm* — Dean W. Russell; Clark F. Weight; Kilpatrick Townsend & Stockton LLP

(57) ABSTRACT

A strike tip for a pick tool, comprising a strike structure joined to a substrate at an interface boundary, the strike structure comprising super-hard material and the substrate comprising carbide material. The strike structure has a strike end opposite the interface boundary, the strike end including a rounded apex having a radius of curvature in a longitudinal plane of at least 3.2 mm and at most 6 mm.

13 Claims, 6 Drawing Sheets

(51) Int. Cl.
*E21C 35/18* (2006.01)
*B28D 1/18* (2006.01)

(56) References Cited

U.S. PATENT DOCUMENTS

| | | | | |
|---|---|---|---|---|
| 5,453,105 | A | 9/1995 | Middlemiss et al. | |
| 6,170,917 | B1 * | 1/2001 | Heinrich et al. | 299/105 |
| 6,179,886 | B1 | 1/2001 | Gordeev et al. | |
| 6,447,852 | B1 | 9/2002 | Gordeev et al. | |
| 6,709,747 | B1 | 3/2004 | Gordeev et al. | |
| 6,919,040 | B2 | 7/2005 | Fries et al. | |
| 7,008,672 | B2 | 3/2006 | Gordeev et al. | |
| 7,396,086 | B1 | 7/2008 | Hall et al. | |
| 7,669,938 | B2 * | 3/2010 | Hall et al. | 299/111 |
| 8,590,643 | B2 * | 11/2013 | Smallman et al. | 175/420.2 |
| 2007/0290545 | A1 * | 12/2007 | Hall et al. | 299/105 |
| 2008/0035389 | A1 | 2/2008 | Hall et al. | |
| 2008/0036271 | A1 | 2/2008 | Hall et al. | |
| 2008/0036280 | A1 | 2/2008 | Hall et al. | |
| 2008/0063476 | A1 | 3/2008 | Hall et al. | |
| 2008/0099251 | A1 | 5/2008 | Hall et al. | |
| 2008/0106139 | A1 | 5/2008 | Hall et al. | |
| 2008/0282584 | A1 | 11/2008 | Hall et al. | |
| 2008/0283256 | A1 | 11/2008 | Hall et al. | |
| 2009/0051211 | A1 | 2/2009 | Hall et al. | |
| 2009/0108664 | A1 | 4/2009 | Hall et al. | |
| 2009/0294182 | A1 | 12/2009 | Hall et al. | |
| 2010/0052407 | A1 * | 3/2010 | Cameron et al. | 299/111 |
| 2010/0065332 | A1 | 3/2010 | Hall et al. | |
| 2011/0291461 | A1 | 12/2011 | Hall et al. | |

FOREIGN PATENT DOCUMENTS

| | | | |
|---|---|---|---|
| WO | 2009006612 | A1 | 1/2009 |
| WO | 2009013713 | A2 | 1/2009 |

OTHER PUBLICATIONS

United Kingdom Application No. 1222337.6, Combined Search and Examination Report mailed on May 24, 2013, 8 pages.

International Application No. PCT/EP2012/075234, International Search Report and Written Opinion mailed on Jan. 3, 0214, 9 pages.

United Kingdom Application No. 1222337.6, Examination Report mailed on Jan. 19, 2015, 2 pages.

United Kingdom Application No. 1222337.6, Notification of Grant mailed on May 12, 2015, 2 pages.

* cited by examiner

SUPER-HARD TIP FOR A PICK TOOL AND PICK TOOL COMPRISING SAME

CROSS REFERENCE TO RELATED APPLICATIONS

This application is the U.S. national phase of International Application No. PCT/EP2012/075234 filed on Dec. 12, 2012, and published in English on Jun. 27, 2013 as International Publication No. WO 2013/092346 A2, which application claims priority to Great Britain Patent Application No. 1122187.6 filed on Dec. 22, 2011 and U.S. Provisional Application No. 61/579,405 filed on Dec. 22, 2011, the contents of all of which are incorporated herein by reference.

This disclosure relates generally to super-hard strike tips for pick tools and pick tools comprising same, particularly but not exclusively for road milling or mining.

U.S. patent application publication number 2009/0051211 discloses a high impact resistant tool having a super-hard material bonded to a cemented metal carbide substrate at a non-planar interface. The super-hard material has a pointed geometry with a sharp apex having 1.27 mm to 3.175 mm radius and a 2.45 mm to 12.7 mm thickness from the apex to the flatted central region of the substrate. According to this prior art, strike tips having a relatively sharper, more pointed apex are less likely to fracture than strike tips having a blunter apex because the latter tend to penetrate substantially less into the body being degraded, thereby providing little buttress support to the diamond substrate and causing the super-hard material to fail in shear/bending at a much lower load with larger surface area. Therefore, it would expected that the blunter tools tend to break at much lower impact energies than sharper tools, which is believed to be due to the distribution of the load across a greater surface area in the sharper tools.

There is a need for a pick tool comprising a super-hard tip having high resistance to wear and fracture.

Viewed from a first aspect there is provided a strike tip for a pick tool, comprising a strike structure joined to a substrate at an interface boundary (between the strike structure and the substrate), the strike structure comprising super-hard material and the substrate comprising carbide material; the strike structure having a strike end opposite the interface boundary, the strike end including a rounded apex having a radius of curvature in a longitudinal plane of greater than 3.176, at least 3.2 mm or at least 3.3 mm and at most about 6 mm, at most about 5 mm or at most about 4 mm (the longitudinal plane passing through the apex and the interface boundary opposite the apex).

Various combinations and arrangements are envisaged by the disclosure, of which the following are non-limiting and non-exhaustive examples.

The pick tool may be for degrading road paving or rock formations in mining operations, for example, and the pick tool may be mounted onto a carrier such as a drum or a fixture joined to a drum for a road milling or mining apparatus.

The super-hard material may comprise or consist of synthetic or natural diamond, polycrystalline diamond (PCD) material, cubic boron nitride (cBN), polycrystalline cubic boron nitride (PCBN) material and or silicon carbide bonded diamond material, for example.

In some example arrangements, the strike structure may comprise PCD material comprising diamond grains having a mean size of at least about 15 microns. The size distribution of the diamond grains used as raw material for the PCD material may be multi-modal, and or the size distribution of the intergrown diamond grains comprised in the PCD material may be multi-modal (the latter size distribution may be measured by means of image analysis of a polished surface of the PCD material).

At least a region of the strike structure adjacent at least a strike area of the strike end may consist of PCD material containing filler material within the interstices between diamond grains, the content of the filler material being greater than 5 weight percent of the PCD material in the region. As used herein, a strike area is an area of the strike end that may impactively engage a body or formation to be degraded when the pick tool strikes the body or formation in use. The filler material may comprise catalyst material for diamond such as cobalt, iron, nickel and or manganese, or alloys or compounds including any of these. In some arrangements, the strike area may include the apex, and may extend substantially over the entire strike end. In some arrangements, the strike structure may consist substantially of PCD material containing filler material in interstices between diamond grains, the content of the filler material being substantially uniform throughout the strike structure, or the content of filler material may vary within a range from at least 5 weight percent to about 20 weight percent of the PCD material.

At least part of the strike end may be generally conical and in some arrangements the strike end may have the general form of a spherically blunted cone, in which the apex is in the general form of rounded cone tip. At least part of the strike surface or a tangent to at least part of the strike surface may be inclined at an angle to a plane tangent to a peripheral side of the strike tip, the angle being at least about 35 degrees or 40 degrees and at most about 55 degrees or 45 degrees. In one particular example, the angle may be substantially 43 degrees.

In various example arrangements, the interface boundary may be substantially planar or non-planar, and may include a depression in the substrate body and or a projection from the substrate body. For example, the interface boundary may be generally dome-shaped, defined by a convex proximate end boundary of the substrate. The proximate end boundary of the substrate may have a radius of curvature in the longitudinal plane of at least about 1 mm, at least about 2 mm or at least about 5 mm, and or at most about 20 mm. In some examples, there may be a depression (concavity) in the proximate boundary end of the substrate opposite the apex of the strike structure. In example arrangements, the thickness of the strike structure between the apex and the interface boundary opposite the apex may be at least about 2.5 mm, and or at most about 10 mm. The height of the strike tip between the apex and a distal end of the strike tip substrate opposite the apex may be at least about 9 mm. In some example arrangements, the proximate end of the substrate may have a generally dome-shaped central area at least partly surrounded by a peripheral shelf, in which the domed-shaped area may include a central depression, or need not include a central depression.

The substrate may comprise cobalt-cement tungsten carbide. In some examples, the super-hard material may be formed joined to the substrate, by which is mean that the super-hard material is produced (for example sintered) in the same general step in which the super-hard structure becomes joined to the substrate. The substrate may comprise cemented tungsten carbide material including at least about 5 weight percent and at most about 10 weight percent or at most about 8 weight percent binder material, which may comprise cobalt (as measured prior to subjecting the substrate to any high-pressure, high temperature condition at which the super-hard structure may be produced; the actual binder content after such treatment is likely to be somewhat lower). The cemented carbide material may have Rockwell hardness of at least about 88 HRa; transverse rupture strength of at least about 2,500 MPa; and or magnetic saturation of at least about 8 $G \cdot cm^3/g$ and at most about 16 $G \cdot cm^3/g$ or at most about 13 $G \cdot cm^3/g$ and coercivity of at least about 6 kA/m and at most about 14 kA/m. Cemented carbide having relatively low binder content is likely to provide enhanced stiffness and support for the tip in use, which may help reduce the risk of fracture, and is likely to exhibit good wear resistance.

In some example arrangements, the strike structure may consist substantially of a single grade of PCD or it may comprise a plurality of PCD grades arranged in various ways, such as in layered or lamination arrangements. The strike structure may comprise a plurality of strata arranged so that adjacent strata comprise different PCD grades, adjacent strata being directly bonded to each other by inter-growth of diamond grains.

In some example arrangements, the substrate may comprise an intermediate volume and a distal volume, the intermediate volume being disposed between the strike structure and a distal volume. The intermediate volume may be greater than the volume of the strike structure and comprise an intermediate material having a mean Young's modulus at least 60% that of the super-hard material.

Viewed from a second aspect, there is provided an assembly for a pick tool comprising a strike tip according to this disclosure, in assembled of no-assembled form.

The assembly may comprise the strike tip joined to a proximate end of a support body. The support body may be generally columnar or cylindrical in shape and the proximate end may be generally frusto-conical. In some example arrangements, the volume of the support body may be at least about 15 $cm^3$ or at least about 25 $cm^3$.

The support body may comprise cemented tungsten carbide, ceramic material, silicon carbide cemented diamond material or super-hard material, and the base may comprise steel. The support material may have Rockwell hardness of at least about 90 HRa and transverse rupture strength of at least about 2,500 MPa. For example, the support body may comprise or consist of cemented tungsten carbide material having magnetic saturation of at least about 7 $G \cdot cm^3/g$ and at most about 11 $G \cdot cm^3/g$ and coercivity of at least about 9 kA/m and at most about 14 kA/m. The support body may comprise or consist of cemented carbide material, which may comprise tungsten carbide grains and at least about 5 weight percent and at most about 10 weight percent or at most about 8 weight percent binder material, which may comprise cobalt. The tungsten carbide grains having a mean size of at most about 6 microns, at most about 5 microns or at most about 3 microns. The mean size of the tungsten carbide grains may be at least about 1 micron or at least about 2 microns.

The support body may be mounted or mountable onto or into a base, which may comprise steel. For example, the support body may be shrink or press fitted into a bore provided in the base, and or the support body may be bonded to the base, such as by brazing.

Non-limiting example arrangements to illustrate the present disclosure are described hereafter with reference to the accompanying drawings, of which:

FIG. 1 to FIG. 4A show schematic cross section views of example strike tips for a pick tool;

Figure 1:
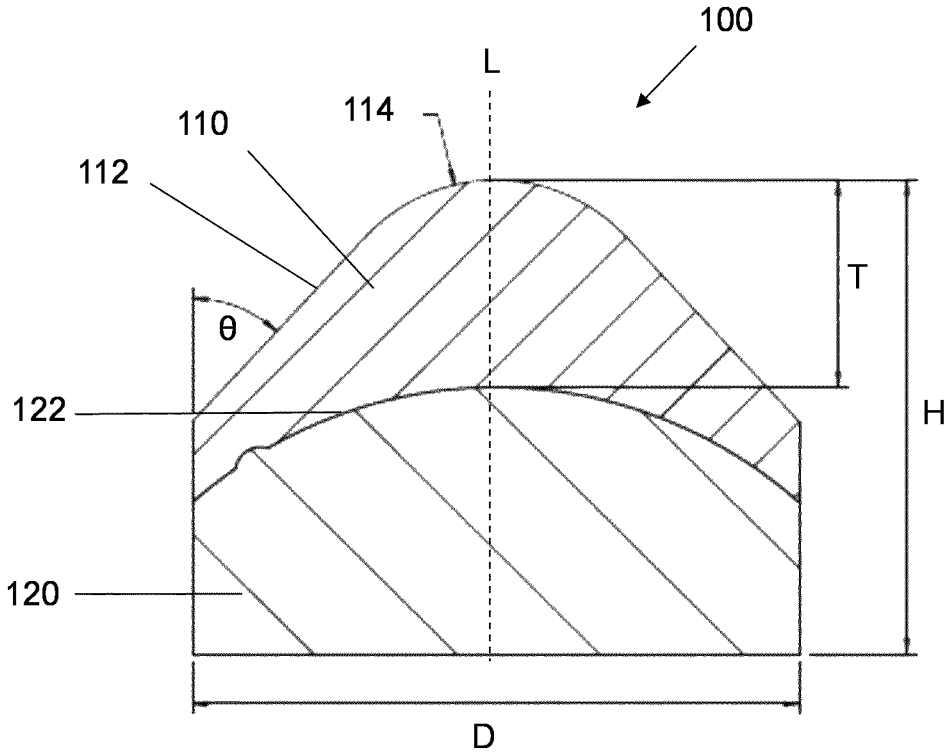

With reference to FIG. 1, an example strike tip 100 comprises a strike structure 110 joined to a cemented carbide substrate 120 at an interface boundary 122 between the substrate 120 and the strike structure. In this example, the strike structure 110 comprises PCD material and has a strike end 112 in the general form of a blunted cone including a spherically blunted cone apex 114. The apex 114 has a radius of curvature in a longitudinal plane of about 3.5 mm, the longitudinal plane being parallel to a longitudinal axis L passing through the apex 114 and the interface boundary 122 opposite the apex 114. The conical surface of the strike end 112 is inclined at an angle θ of about 43 degrees with respect to a plane tangent to a peripheral side surface of the strike tip 100. The interface boundary 122 is generally dome-shaped and defined by a spherically convex proximate end of the substrate 120 having a radius of curvature in the longitudinal plane of about 9 mm. The thickness T of the PCD strike structure between the apex 114 and the interface boundary 122 opposite the apex 114 is about 4 mm. The overall height H of the strike tip 100 between the apex 114 and a distal end of the substrate 120 opposite the proximate end defining the boundary 122 is about 9.4 mm. The volume of the PCD strike structure 110 is about 280.7 cubic mm and the volume of the substrate is about 476 cubic mm. In other example arrangements, the volume of the PCD strike structure 110 may be at least 70 percent and at most 150 percent of the volume of the substrate 120. The PCD material comprises about 82 weight percent substantially inter-gown diamond grains and about 18 weight percent filler material disposed in the interstitial regions between the diamond grains, the filler material comprising cobalt. The diamond grains have a multi-modal size distribution and a mean size of about 20 microns. The substrate 120 comprises cobalt-cemented tungsten carbide material comprising about 92 weight percent tungsten carbide (WC) grains and about 8 weight percent cobalt (Co). The magnetic saturation of the cemented carbide material is in the range from about 132 to about 136 in units of 0.1 micro-Tesla times cubic meter per kilogram ($\mu T \cdot m^3/kg$) or about 10.5 to about 12.8 $G \cdot cm^3/g$, and the magnetic coercivity is in the range from about 7.2 to about 8.8 kA/m or about 90 to about 110 Oe. The hardness of the cemented carbide material is about 88.7 HRa, the transverse rupture strength is about 2,800 MPa, the fracture toughness is about 14.6 MPa and the Young's modulus is about 600 MPa.

Figure 2:
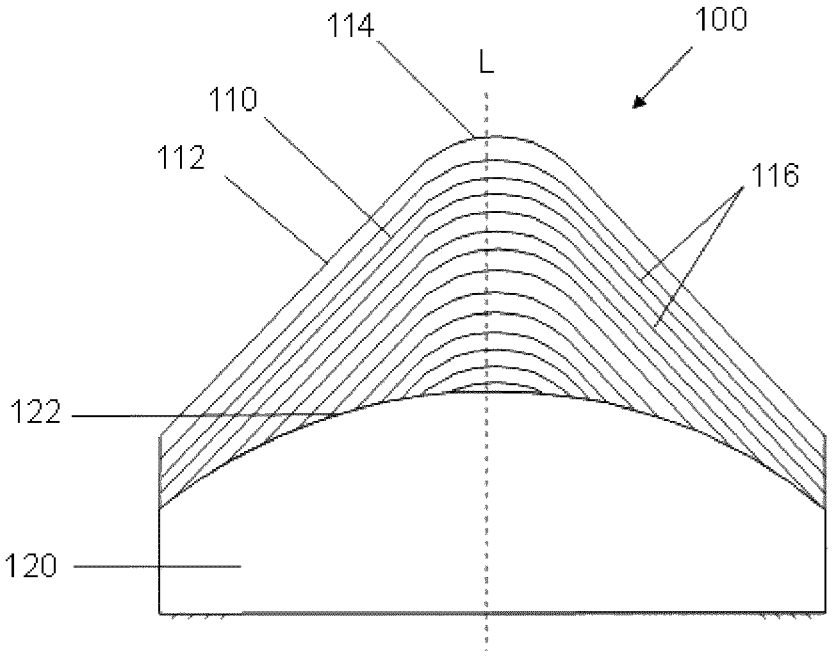

The example strike tip 100 illustrated in FIG. 2 has substantially the same structural features and dimensions as that described with reference to FIG. 1 except that the PCD strike structure 110 comprises a plurality of layers or strata 116, in which consecutive layers 116 comprise different grades of PCD material arranged alternately. The layers 116 may be configured to direct cracks generated near the strike end 112 in use away from an inner region of the PCD strike structure 110 or away from the boundary 122 with the substrate 120. In some example arrangements, the layers 116 may be arranged generally conformal with at least part of the strike end 114 and may have a thickness in the range of around 30 to 300 microns.

Figure 3:
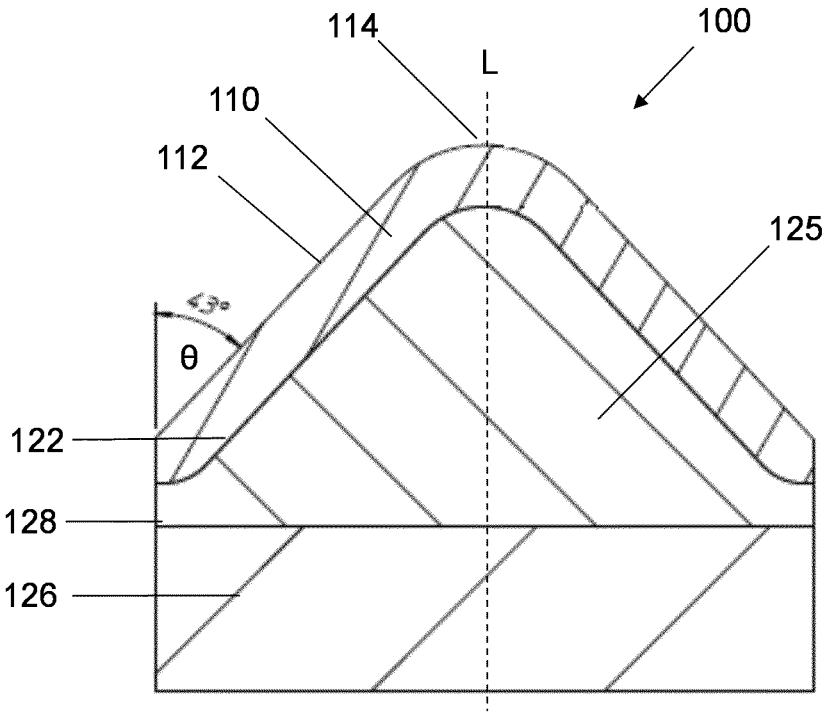

In the example strike tip 100 illustrated in FIG. 3, the substrate comprises an intermediate volume 125 and a distal volume 126, the intermediate volume 125 disposed between the strike structure 110 and a distal volume 126. The intermediate volume 125 is greater than the volume of the strike structure 110 and comprises an intermediate material having a mean Young's modulus at least 60% that of the super-hard material. The interface boundary 122 between the strike structure 110 and the intermediate volume 125 is generally conical and generally conformal with the strike end 112. The intermediate volume 125 is joined to the distal volume 126 at a boundary 128 remote from the strike structure 110. The intermediate volume has stiffness that is intermediate that of the strike structure 110 and the distal volume 124 of the substrate and may comprise a material having a Young's modulus of at least about 650 GPa and at most about 900 GPa. In this particular example, the intermediate volume 125 comprises carbide grains and diamond grains and the Young's modulus of the strike structure 110 is at least about 1,000 GPa. The apex 114 of the strike structure 110 has a longitudinal radius of curvature of about 3.5 mm.

Figure 4A:
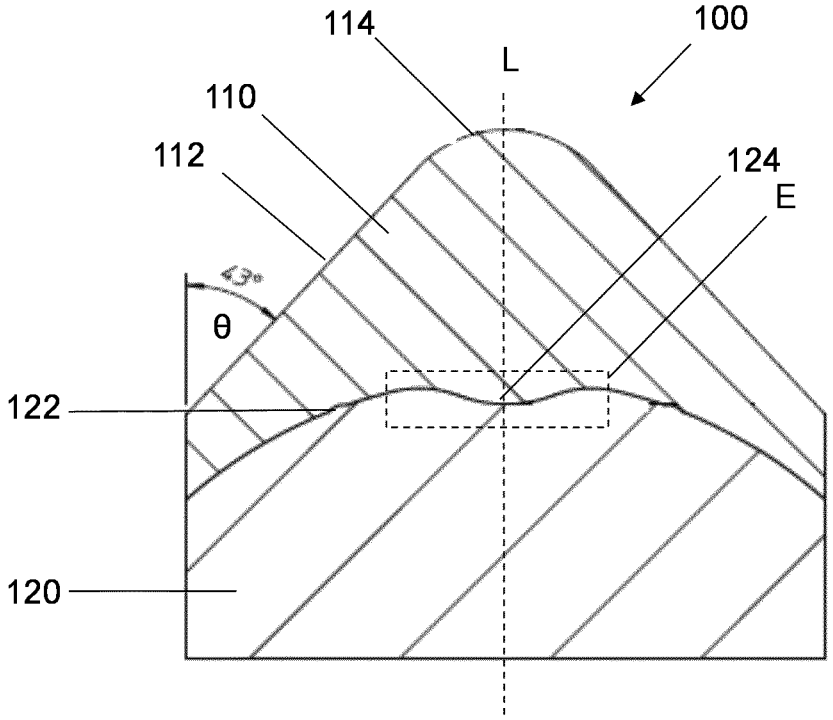
Figure 4B:
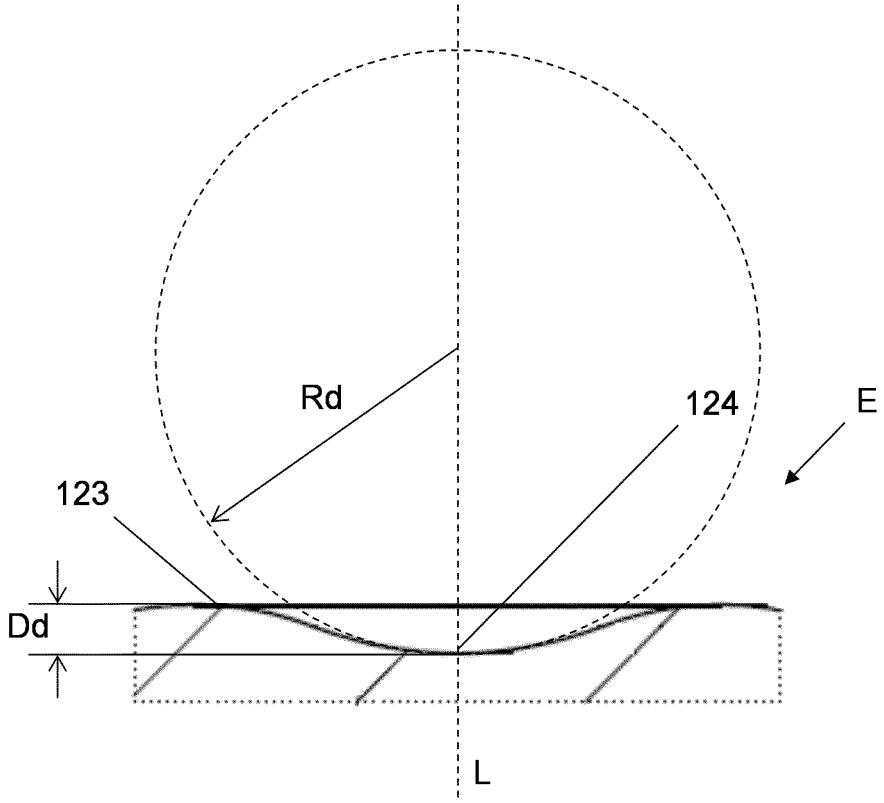
FIG. 4B shows an enlarged view of the region E in FIG. 4A.

The example strike tip 100 illustrated by FIG. 4A and FIG. 4B has substantially the same structural features and dimensions as that described above with reference to FIG. 1, except that there is a depression 124 in the interface boundary 122, the bottom of the depression being opposite the apex 114 of the strike structure 110 and defined by a concavity in the otherwise generally convex proximate end of the substrate 120. The proximate end of the substrate 120 can be described as hollow-point dome, in which the depression 124 is at least partly surrounded by a ridge 123. The depression 124 may have a longitudinal radius of curvature Rd (i.e. in a plane parallel to L) of at least about 0.5 mm and at most about 10 mm, and a depth Dd from a surrounding ridge 123 of at least about 0.1 mm and at most about 1 mm. In one particular example, the depth Rd is about 0.3 mm.

Figure 5:
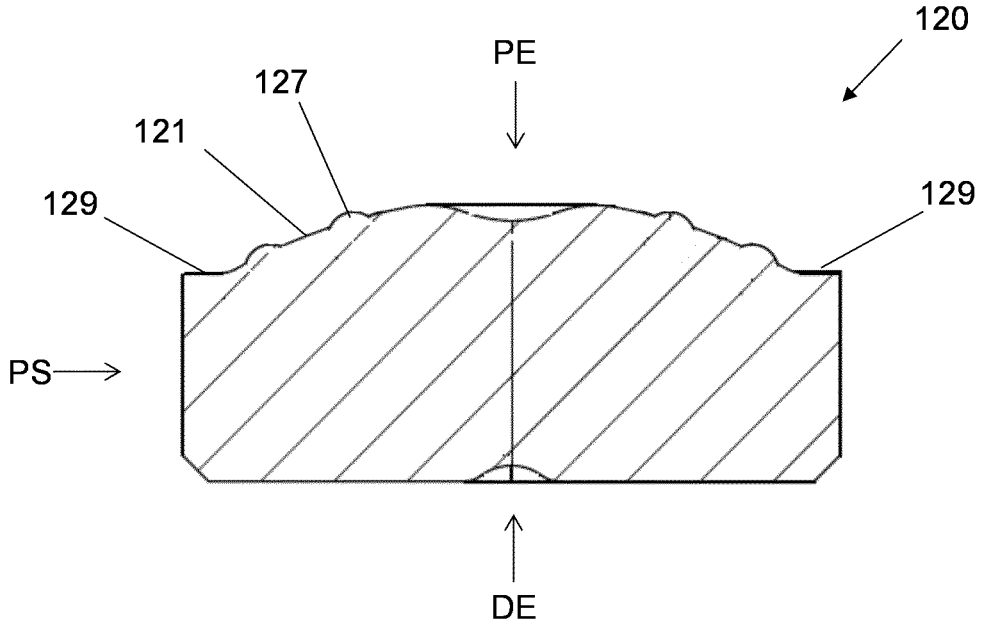
FIG. 5 shows a schematic cross section view of an example substrate for an example strike tip.
Figure 6:
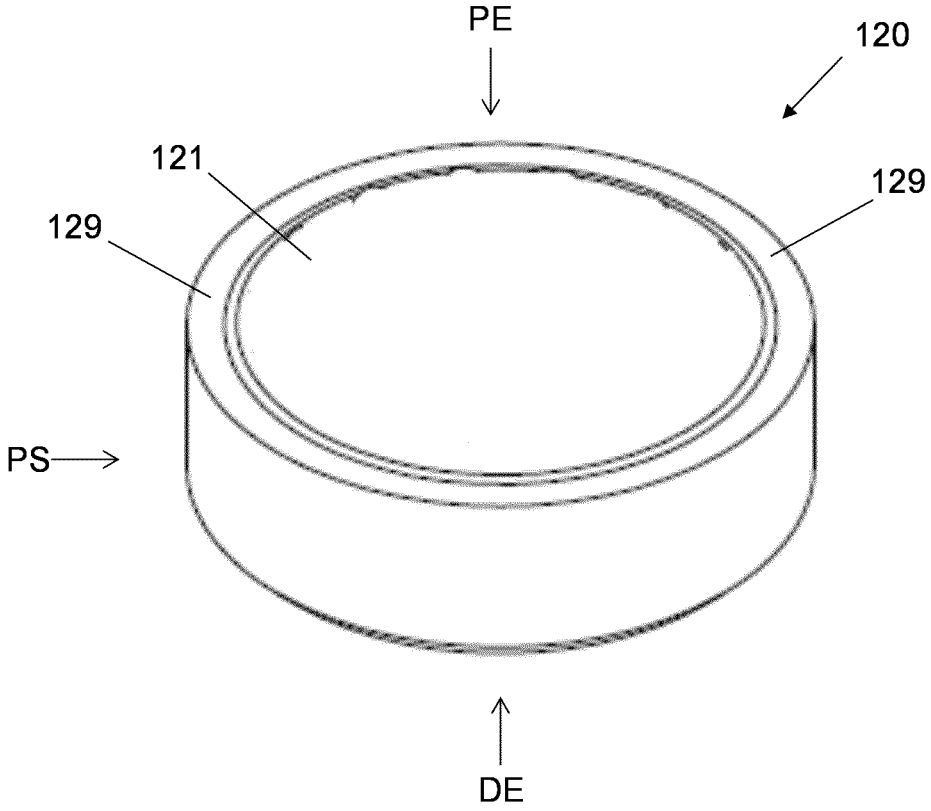
FIG. 6 shows a schematic perspective view of an example substrate for an example strike tip.

With reference to FIG. 5 and FIG. 6, an example substrate 120 for a strike tip may have a proximate end PE and an opposite distal end DE, the proximate and distal ends PE, DE being connected by a cylindrical peripheral side surface PS. In this particular example, the proximate end PE is configured to comprise a convex dome-shaped area 121 surrounded by a circumferential shelf area 129. The shape of the proximate end PE will substantially determine the shape of the interface boundary between the super-hard strike structure and the substrate 120. The circumferential shelf area 129 may extend substantially laterally with respect to the longitudinal axis L. In this particular example, the circumferential shelf 129 is about 1 mm wide.

In the example illustrated by FIG. 5, the convex dome-shaped area 121 includes a plurality of generally hemispherical projections 127 and in the example illustrated in FIG. 6 the convex dome area is free of projections. In some examples (not shown), the proximate end PE may include a plurality of hemispherical projections but not a circumferential shelf area 129, at least part of the convex dome-shaped area 121 extending substantially to the edge of the peripheral side surface PS. In the examples illustrated in FIG. 5 and FIG. 6, the proximate end PE includes a central depression 124 formed into the centre of the convex dome-shaped area 121. In other example arrangements (not shown), the proximate end PE need not include a depression.

Figure 7:
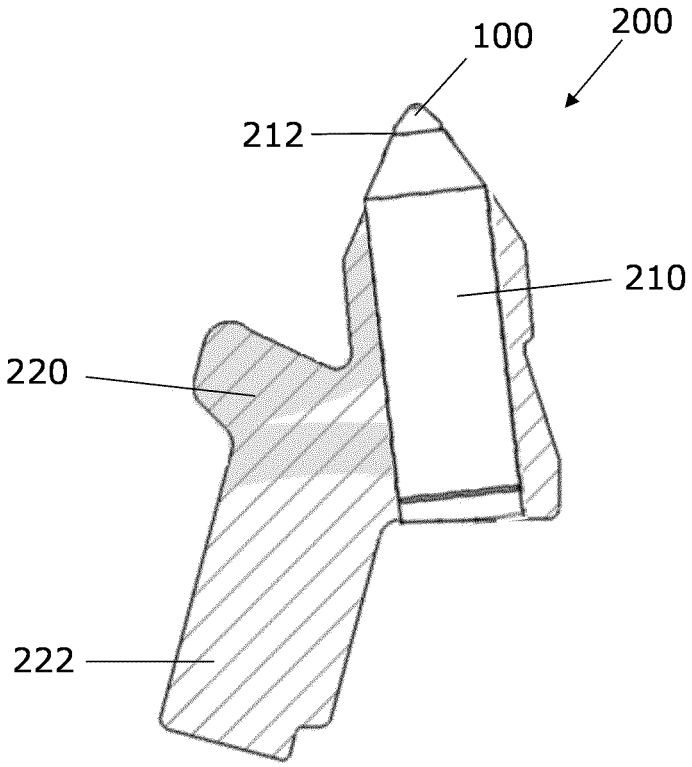
FIG. 7 and FIG. 8 show schematic longitudinal cross section views of example pick tools.
Figure 8:
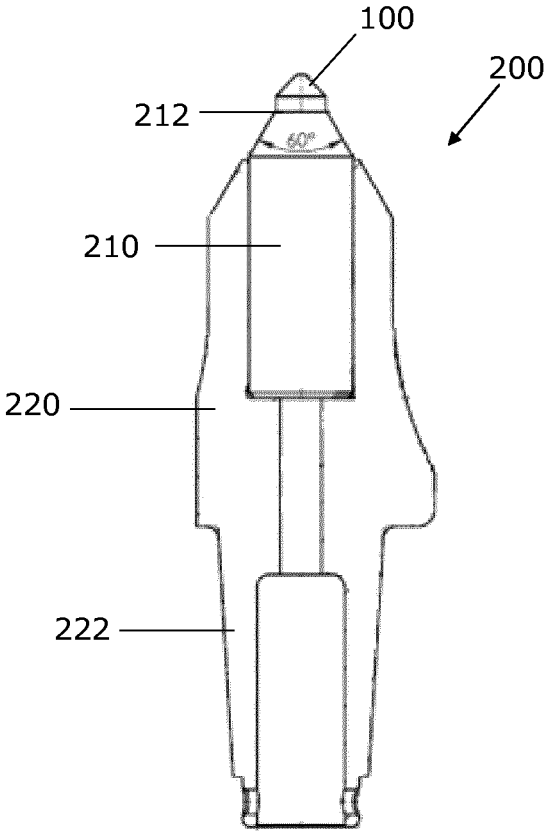

With reference to FIG. 7 and FIG. 8, example pick tool arrangements 200 each comprise a tip 100 joined to a support body 210 at a join interface boundary 212 and the support body 210 comprises an insertion shaft, which is shrink fit into a bore formed into the base 220. The base 220 has a shank 222 for mounting the pick 200 onto a drum (not shown) via a coupling mechanism (not shown). In the example arrangement shown in FIG. 7, the shank 222 is substantially not aligned with the insertion shaft of the support body 210, while in the example arrangement shown in FIG. 8, the shank 222 is generally aligned with the insertion shaft of the support body 210. The volume of the support body 210 may be about 30 $cm^3$ and the length of the support body 210 may be about 6.8 cm. As used herein, a shrink fit is a kind of interference fit between components achieved by a relative size change in at least one of the components (the shape may also change somewhat). This is usually achieved by heating or cooling one component before assembly and allowing it to return to the ambient temperature after assembly. Shrink-fitting is understood to be contrasted with press-fitting, in which a component is forced into a bore or recess within another component, which may involve generating substantial frictional stress between the components. In some variants, the support body 210 comprises a cemented carbide material comprising grains of tungsten carbide having a mean size of at about 2.5 microns to about 3 microns, and at most about 10 weight percent of metal binder material, such as cobalt (Co). Shrink fitting the support body 210 into the base 220 may allow relatively stiff grades of cemented carbide to be used, which is likely to enhance support for the tip 100 and reduce the risk of fracture. In order to reduce stresses, sharp corners at points of contact may be avoided. For example, edges and corners may be radiused or chamfered, and the edge of the bore may be provided with a radius or chamfer to reduce the risk of stress-related cracks arising.

In use, a strike tip mounted on a pick tool is driven to impact a body or formation to be degraded. In road milling or mining, a plurality of picks each comprising a strike tip may be mounted onto a drum. The drum will be coupled to and driven by a vehicle, causing the drum to rotate and the picks repeatedly to strike the asphalt or rock, for example, as the drum rotates. The picks will generally be arranged so the each strike tip does not strike the body directly with the top of the apex, but somewhat obliquely to achieve a digging action in which the body is locally broken up by the strike tip. Repeated impact of the strike tip against hard material is likely to result in the abrasive wear and or fracture of the strike tip and or other parts of the pick.

Example methods for making a tip comprising a PCD structure formed joined to a substrate will now be described.

In general, a tip may be made by placing an aggregation comprising a plurality of diamond grains onto a cemented carbide substrate and subjecting the resulting assembly in the presence of a catalyst material for diamond to an ultra-high pressure and high temperature at which diamond is more thermodynamically stable than graphite, to sinter together the diamond grains and form a PCD structure joined to the substrate body. Binder material within the cemented carbide substrate body may provide a source of the catalyst material, such as cobalt, iron or nickel, or mixtures or alloys including any of these. A source of catalyst material may be provided within the aggregation of diamond grains, in the form of admixed powder or deposits on the diamond grains, for example. A source of catalyst material may be provided proximate a boundary of the aggregation other than the boundary between the aggregation and the substrate body, for example adjacent a boundary of the aggregation that will correspond to the strike end of the sintered PCD structure.

In some example methods, the aggregation may comprise substantially loose diamond grains, or diamond grains held together by a binder material. The aggregations may be in the form of granules, discs, wafers or sheets, and may contain catalyst material for diamond and or additives for reducing abnormal diamond grain growth, for example, or the aggregation may be substantially free of catalyst material or additives.

In some example methods, aggregations in the form of sheets comprising a plurality of diamond grains held together by a binder material may be provided. The sheets may be made by a method such as extrusion or tape casting, in which slurries comprising diamond grains having respective size distributions suitable for making the desired respective PCD grades, and a binder material is spread onto a surface and allowed to dry. Other methods for making diamond-containing sheets may also be used, such as described in U.S. Pat. Nos. 5,766,394 and 6,446,740. Alternative methods for depositing diamond-bearing layers include spraying methods, such as thermal spraying. The binder material may comprise a water-based organic binder such as methyl cellulose or polyethylene glycol (PEG) and different sheets comprising diamond grains having different size distributions, diamond content and or additives may be provided. For example, sheets comprising diamond grains having a mean size in the range from about 15 microns to about 80 microns may be provided. Discs may be cut from the sheet or the sheet may be fragmented. The sheets may also contain catalyst material for diamond, such as cobalt, and or precursor material for the catalyst material, and or additives for inhibiting abnormal growth of the diamond grains or enhancing the properties of the PCD material. For example, the sheets may contain about 0.5 weight percent to about 5 weight percent of vanadium carbide, chromium carbide or tungsten carbide.

In some versions of the example method, the aggregation of diamond grains may include precursor material for catalyst material. For example, the aggregation may include metal carbonate precursor material, in particular metal carbonate crystals, and the method may include converting the binder precursor material to the corresponding metal oxide (for example, by pyrolysis or decomposition), admixing the metal oxide based binder precursor material with a mass of diamond particles, and milling the mixture to produce metal oxide precursor material dispersed over the surfaces of the diamond particles. The metal carbonate crystals may be selected from cobalt carbonate, nickel carbonate, copper carbonate and the like, in particular cobalt carbonate. The catalyst precursor material may be milled until the mean particle size of the metal oxide is in the range from about 5 nm to about 200 nm. The metal oxide may be reduced to a metal dispersion, for example in a vacuum in the presence of carbon and/or by hydrogen reduction. The controlled pyrolysis of a metal carbonate, such as cobalt carbonate crystals provides a method for producing the corresponding metal oxide, for example cobalt oxide ($Co_3O_4$), which can be reduced to form cobalt metal dispersions. The reduction of the oxide may be carried out in a vacuum in the presence of carbon and/or by hydrogen reduction.

A substrate body comprising cemented carbide in which the cement or binder material comprises a catalyst material for diamond, such as cobalt, may be provided. The substrate body may have a non-planar or a substantially planar proximate end on which the PCD structure is to be formed. For example, the proximate end may be configured to reduce or at least modify residual stress within the PCD. A cup having a generally conical internal surface may be provided for use in assembling the diamond aggregation, which may be in the form of an assembly of diamond-containing sheets, onto the substrate body. The aggregation may be placed into the cup and arranged to fit substantially conformally against the internal surface. The substrate body may then be inserted into the cup with the proximate end going in first and pushed against the aggregation of diamond grains. The substrate body may be firmly held against the aggregation by means of a second cup placed over it and inter-engaging or joining with the first cup to form a pre-sinter assembly.

The pre-sinter assembly can be placed into a capsule for an ultra-high pressure press and subjected to an ultra-high pressure of at least about 5.5 GPa and a temperature of at least about 1,300 degrees centigrade to sinter the diamond grains and form a construction comprising a PCD structure sintered onto the substrate body. In one version of the method, when the pre-sinter assembly is treated at the ultra-high pressure and high temperature, the binder material within the support body melts and infiltrates the aggregation of diamond grains. The presence of the molten catalyst material from the support body and or from a source provided within the aggregation will promote the sintering of the diamond grains by intergrowth with each other to form a PCD structure.

Where a strike tip comprises super-hard material such as PCD, abrasive wear of the strike tip is relatively less important because super-hard material is relatively abrasion resistant and the most likely failure mode will be fracture, since super-hard material tends to be relatively prone to fracture. While wishing not to be bound by a particular theory, repeated impact on the strike tip as in road milling or mining is likely to induce fatigue-related crack propagation and fracture as cracks are likely to increase in size with each impact until a crack progresses to a surface of the strike tip and a portion of the strike tip breaks off. For at least this reason, the likely mean working life of a type of strike tip may be indicated by means of a laboratory test involving cyclic impact of a strike tip onto a hard body as well as by monotonic loading of the strike tip.

Disclosed strike tips and picks comprising them may have the aspect of good working life, at least because of reduced risk of fracture or substantially delayed fracture. They are also likely to be relatively easier and efficient to manufacture at least because the incidence of sinter defects is likely to be reduced. While wanting not to be limited by a particular theory, this may be due to the likelihood of more homogeneous infiltration of catalyst material from the substrate through the aggregation of diamond grains to the apex during the sintering step, in which the super-hard strike structure is sintered. In addition, the risk of substantial deformation of the blunter apex during the sinter step may be expected to be reduced. Blunter strike tips may also be expected to be less prone to accidental breakage during handling in the field. As a trade-off for these aspects, it may be expected that the force required per pick to break the body or formation being degraded would be higher if the strike tips are blunter and power consumption may be slightly greater. However, the forces and power consumption are expected to be substantially less or at least no greater than required when using conventional cemented carbide strike tips, which are prone to substantial blunting in use as a result of their substantially lower wear resistance than super-hard strike tips.

Arrangements of strike tips in which the strike structure comprises or substantially consists of PCD material comprising more than 5 weight percent filler material proximate or adjacent a strike surface of the strike end are likely to exhibit enhanced fracture toughness. As a trade-off, PCD having relatively higher content of filler material with respect to diamond tends to have reduced wear resistance A non-limiting example is described in detail below.

Several example strike tips as described above with reference to FIG. 1 and several control strike tips were provided and subjected to monotonic loading and cyclic impact testing. The control tip comprised a PCD strike structure, the strike end of which had the general shape of a spherically blunted cone and the apex of which had a radius of curvature of 2.4 mm.

The monotonic loading test involved subjecting each strike tip to an increasing load up to a maximum of 100 kN or until it fractured. The load was applied by driving a load element vertically down onto the strike tip, the load element comprising a PCD structure having a substantially planar surface. The strike tip was mounted in a jig and held canted at an angle of 32 degrees to the vertical and a small, substantially flat contact area of about 2 to 3 square mm was ground onto the tip proximate the apex, where there load element would impinge the tip. The strike tip held securely by the jig was positioned within a Universal Tester (Instron 5500R™) and the load element was driven down at a constant advance rate of 0.1 mm/min until one of the following failure criteria was met: complete failure of the shaped cutter, failure of the PCD load element or the maximum load was reached. The first of these is expected to provide a more reasonable indication of the strength of the strike tip than the other two. The failure load was divided by the contact area in order to give an indication of contact stress, which is a measure of the combined effect of several aspects including the strength of the strike structure, residual stresses within the strike tip and geometrical effects arising from the cant angle.

Ten example tips and fifteen control tips were subjected to the monotonic loading test. The mean failure contact stress of the control tips was less than 20 GPa, while that of the example tips was about 25 GPa, indicating that the example strike tip was superior in this respect (in fact the example strike tip may be even better than this because in eight out of ten tests the PCD load element broke, indicating that the failure stress of the example tip generally exceeded that of the load element).

Six example tips and fifteen control tips were subjected to an impact test that involved repeatedly impacting the tips. The control strike tips exhibited a wide distribution in the number of impacts to failure, from less than 250 to more than 1,000, while all of the example tips survived without failure to greater than 1,000 impacts.

These tests strongly indicate that the strike tips according to this disclosure are likely to exhibit substantially enhanced performance, at least in terms of working life, in use as degradation tools for road milling and mining.

Certain terms and concepts as used herein are briefly explained below.

Synthetic and natural diamond, polycrystalline diamond (PCD), cubic boron nitride (cBN) and polycrystalline cBN (PCBN) material are examples of superhard materials. As used herein, synthetic diamond, which is also called man-made diamond, is diamond material that has been manufactured. As used herein, polycrystalline diamond (PCD) material comprises an aggregation of a plurality of diamond grains, a substantial portion of which are directly inter-bonded with each other and in which the content of diamond is at least about 80 volume percent of the material. Interstices between the diamond grains may be at least partly filled with a filler material that may comprise catalyst material for synthetic diamond, or they may be substantially empty. As used herein, a catalyst material for synthetic diamond is capable of promoting the growth of synthetic diamond grains and or the direct inter-growth of synthetic or natural diamond grains at a temperature and pressure at which synthetic or natural diamond is thermodynamically stable. Examples of catalyst materials for diamond are Fe, Ni, Co and Mn, and certain alloys including these. Bodies comprising PCD material may comprise at least a region from which catalyst material has been removed from the interstices, leaving interstitial voids between the diamond grains.

As used herein, a PCD grade is a variant of PCD material characterised in terms of the volume content and or size of diamond grains, the volume content of interstitial regions between the diamond grains and composition of material that may be present within the interstitial regions. Different PCD grades may have different microstructure and different mechanical properties, such as elastic (or Young's) modulus E, modulus of elasticity, transverse rupture strength (TRS), toughness (such as so-called $K_1C$ toughness), hardness, density and coefficient of thermal expansion (CTE). Different PCD grades may also perform differently in use. For example, the wear rate and fracture resistance of different PCD grades may be different.

As used herein, PCBN material comprises grains of cubic boron nitride (cBN) dispersed within a matrix comprising metal or ceramic material.

Other examples of superhard materials include certain composite materials comprising diamond or cBN grains held together by a matrix comprising ceramic material, such as silicon carbide (SiC), or cemented carbide material, such as Co-bonded WC material (for example, as described in U.S. Pat. Nos. 5,453,105 or 6,919,040). For example, certain SiC-bonded diamond materials may comprise at least about 30 volume percent diamond grains dispersed in a SiC matrix (which may contain a minor amount of Si in a form other than SiC). Examples of SiC-bonded diamond materials are described in U.S. Pat. Nos. 7,008,672; 6,709,747; 6,179,886; 6,447,852; and International Application publication number WO 2009/013713).

Where the weight or volume percent content of a constituent of a polycrystalline or composite material is measured, it is understood that the volume of the material within which the content is measured is to be sufficiently large that the measurement is substantially representative of the bulk characteristics of the material. For example, if PCD material comprises inter-grown diamond grains and cobalt filler material disposed in interstices between the diamond grains, the content of the filler material in terms of volume or weight percent of the PCD material should be measured over a volume of the PCD material that is at least several times the volume of the diamond grains so that the mean ratio of filler material to diamond material is a substantially true representation of that within a bulk sample of the PCD material (of the same grade).

The invention claimed is:

1. A strike tip for a pick tool, comprising a strike structure joined to a substrate at an interface boundary and having a strike end opposite the interface boundary, the strike structure comprising polycrystalline diamond (PCD) material and the substrate comprising carbide material; the interface boundary being dome-shaped, defined by a convex proximate end boundary of the substrate having a radius of curvature in the longitudinal plane of 5 to 20 mm and being free of a central depression; the strike end including a rounded apex having a radius of curvature in a longitudinal plane of 3.2 mm to 6 mm; and the thickness of the strike structure between the apex and the interface boundary opposite the apex being 2.5 to 10 mm.

2. A strike tip as claimed in claim 1, in which the pick tool is for degrading road paving or rock formations in mining operations.

3. A strike tip as claimed in claim 1, in which the PCD material comprises diamond grains having a mean size of at least 15 microns.

4. A strike tip as claimed in claim 1, in which the strike end has the general form of a spherically blunted cone.

5. A strike tip as claimed in claim 1, in which the height of the strike tip between the apex and a distal end of the strike tip substrate opposite the apex is at least 9 mm.

6. A strike tip as claimed in claim 1, in which the substrate comprises cemented tungsten carbide material including at least 5 weight percent and at most about 10 weight percent binder material comprising cobalt.

7. A strike tip as claimed in claim 1, in which the substrate comprises cemented carbide material having Rockwell hardness of at least 88 HRa, transverse rupture strength of at least about 2,500 MPa, magnetic saturation of at least 8 $G \cdot cm^3/g$ and at most 16 $G \cdot cm^3/g$ and coercivity of at least 6 kA/m and at most 14 kA/m.

8. A strike tip as claimed in claim 1, in which the strike structure comprises a plurality of grades of PCD material arranged as strata in a layered configuration, adjacent strata being directly bonded to each other by inter-growth of diamond grains.

9. A strike tip as claimed in claim 1, in which the substrate comprises an intermediate volume and a distal volume, the intermediate volume disposed between the strike structure and a distal volume and the intermediate volume being greater than the volume of the strike structure and comprising an intermediate material having a mean Young's modulus at least 60% that of the super-hard material.

10. An assembly for a pick tool, in assembled, partially assembled or unassembled condition, comprising a strike tip as claimed in claim 1 and a support body.

11. An assembly as claimed in claim 10, in which the strike tip is joined to a proximate end of an elongate support body, the support body being shrink fit within a bore provided within a steel base.

12. An assembly as claimed in claim 11, in which the support body comprises cemented carbide material including at least 5 weight percent and at most 10 weight percent binder material comprising cobalt.

13. An assembly as claimed in claim 12, in which the support body comprises cemented tungsten carbide material having Rockwell hardness of at least 90 HRa, transverse rupture strength of at least 2,500 MPa, magnetic saturation of at least 7 $G \cdot cm^3/g$ and at most 11 $G \cdot cm^3/g$ and coercivity of at least 6 kA/m and at most 11 kA/m.

* * * * *